US005471940A

United States Patent [19]

Wakana

[11] Patent Number: 5,471,940

[45] Date of Patent: Dec. 5, 1995

[54] SEWING MAHINE DRIVE APPARATUS AND METHOD

[75] Inventor: Takayuki Wakana, Aichi, Japan

[73] Assignee: Mitsubishi Denki Kabushiki Kaisha, Tokyo, Japan

[21] Appl. No.: 141,209

[22] Filed: Oct. 26, 1993

[30] Foreign Application Priority Data

Oct. 27, 1992 [JP] Japan ..... 4-288706
Mar. 30, 1993 [JP] Japan ..... 5-071721

[51] Int. Cl.[6] ..... D05B 69/12

[52] U.S. Cl. ..... 112/220

[58] Field of Search ..... 112/275, 277, 112/220, 121.11, 262.1, 221; 318/369, 467, 275, 567

[56] References Cited

U.S. PATENT DOCUMENTS 4,691,653 9/1987 Neki et al. ..... 112/275
4,754,721 7/1988 Skogward ..... 112/275

*Primary Examiner*—Peter Nerbun
*Attorney, Agent, or Firm*—Sughrue, Mion, Zinn, Macpeak & Seas; Richard C. Turner

[57] ABSTRACT

A sewing machine apparatus driven by a motor, which is subject to velocity control on the basis of a detector for determining the rotary position and/or velocity of the motor output shaft. A controller is operative to control the speed of the motor in accordance with a velocity command value. A means for generating a holding force during a stop of the sewing machine ensures that the sewing needle does not provide unwanted movement. The holding force is changed when movement from the stop position is desired, as by changing the force in relation to the speed or amount of movement. This feature is particularly useful to reduce the load presented to an operator who wishes to manually change the machine position.

21 Claims, 18 Drawing Sheets

SEWING MAHINE DRIVE APPARATUS AND METHOD

BACKGROUND OF THE INVENTION

1. Field of the Invention

The present invention relates to a sewing machine drive apparatus which causes a sewing machine to generate holding force to keep a machine needle from moving and sticking into a cloth, or an object to be stitched, during a stop of the sewing machine.

2. Description of the Background Art

FIG. 17(*a*) shows the arrangement of a conventional sewing machine drive apparatus, wherein the numeral 1 indicates a sewing machine, 2 denotes drive means, e.g., a motor, which drives the sewing machine 1, 3 designates a sewing machine pulley, 4 represents a motor pulley, 5 indicates a belt which couples the pulleys 3 and 4, 6 designates a needle position detector fitted to the sewing machine 1 to detect the needle position of the sewing machine 1, 7 represents a detector which detects the position or velocity of the motor 2, 8 denotes a control box which controls the motor 2 to operate the sewing machine 1, 9 indicates a pedal operated by a worker to operate the sewing machine 1, and 10 represents a lever unit which converts the operation value of the pedal 9 into an electrical signal (for example, a velocity command value) and inputs the signal to the control box 8.

In the apparatus designed as described above, when the worker depresses the pedal 9, its depression value is converted into a velocity command value by the lever unit 10, the control box 8 operates the motor 2 at variable speed according to that velocity command value, and its drive force is transmitted to the motor pulley 4, the belt 5 and the sewing machine pulley 3 to operate the sewing machine 1. When, for example, the worker attempts to take out the cloth on completion of stitching after the operation of the sewing machine 1 through the control of the pedal 9, the sewing machine 1 must be stopped at a needle UP position to keep its needle from sticking into the cloth.

In some sewing machines 1 which utilize a presser bar plate spring, the spring is designed to be unloaded at a stop point in the needle UP position, shown at an 11 o'clock position of spindle rotation in FIG. 17(*b*). At other positions, the spring tends to bring the spindle back to the needle UP position, and is at a maximum compression at top dead center, shown as the 12 o'clock position. For example, because of the force of the spring (the force of motion is hereinafter referred to as the "machine load"), the sewing machine will rotate in the forward direction (counterclockwise) when the spindle is in a position after the 12 o'clock position, and will rotate in a reverse direction (clockwise) when the spindle is in a position prior to the 12 o'clock position. Accordingly, after a stop, this conventional sewing machine 1 continues to move and the needle position shifts. As a result, in an extreme case, the needle will stick into the cloth, and the cloth cannot be taken out.

For this reason, the conventional system may implement the position control of the motor 2 such that, during a stop of the sewing machine 1, the position control generates a torque for the motor 2 which is opposite to the direction in which the sewing machine 1 attempts to move, thereby providing holding force. Further, if there is a position deviation which exceeds a set value, the position control is designed to be cleared so that the worker can shift the needle position of the sewing machine 1 by hand in order to, for example, check the piercing position of the needle while such holding force control is being executed. These methods are described in details in, for example, Japanese Laid-Open Patent Publication No. SHO 62-106798.

FIG. 18 is a block arrangement diagram of a conventional sewing machine drive apparatus, wherein the numeral 11 indicates velocity command value changing unit, e.g., a selector switch, which is connected to point "a" in FIG. 18 to perform a variable-speed operation under the control of a velocity command from the lever unit 10 and is moved to a position control position at point "b" at the time of a stop to generate holding force during a stop (a position control during a stop is hereinafter referred to as a "soft brake"). 12 designates a velocity/torque conversion section which converts any velocity deviation, determined by the differences between the velocity command value and a velocity feedback value, into a torque command value. 13 represents a torque limiter which limits the torque command value to keep it from exceeding a set value. 14 denotes a driver consisting of power transistors, etc., to drive the motor 2 according to the torque command value. 15 indicates a detector, which may comprise an encoder within the motor 2, for detecting (conventionally by means of a light source, a light sensor, and rotary discs fitted to the motor shaft and provided with slits at predetermined locations) the angular value (travel) of the shaft of the motor 2. It is generally known that two sensors, which are disposed to electrically provide two phase pulse signals A and B with a phase difference of approximately 90° , allow a rotation direction also to be detected. 16 represents a velocity detection section which detects velocity from such phased pulse signals A, B. The velocity detected thereby (hereinafter referred to as the "velocity feedback") is further converted into a positive or a negative value according to the rotation direction determined by using the method. 17 denotes a position detection section from which the direction of travel is output as a value whose polarity (positive or negative) is determined according to the rotation direction detected by the velocity detection section 16. 18 designates a position control section which exercises position control according to the movement value (hereinafter referred to as the "position feedback") from the position detection section 17. 20 indicates a position/velocity conversion section which converts the output of the position control section 18 into a velocity command value.

The operation of the sewing machine drive apparatus designed as described above will now be described in accordance with FIGS. 17(*a*) and (*b*), 18 and 19(*a*) and (*b*). FIGS. 19(*a*) and (*b*) show a relationship between position deviation and torque that is pertinent to the operation of the apparatus.

First, when the worker depresses the pedal 9, its depression value is converted into an electrical signal (velocity command value) by the lever unit 10. The velocity feedback from the velocity detection section 16 is subtracted from the electrical signal at the summing node 8*a* in the control box 8 and results in a velocity deviation value. The velocity deviation is converted into a torque command value by the velocity/torque conversion section 12. According to this torque command value, the driver 14 operates the motor 2. This is the typical movement performed during the operation of the sewing machine 1.

When the pedal 9 is set to a neutral position (a state wherein the worker does not depress the pedal), the velocity command value is zeroed, the motor 2 comes to a stop, and the sewing machine 1 is also brought to a stop. It is to be understood that some sewing machine drive apparatuses have an orientation function which allows the sewing machine to be positioned to a stop at its needle UP or DOWN position under the control of the signal from the needle position detector 6, but such sewing machines will not be described here.

When the sewing machine 1 comes to a stop, the selector switch 11 is moved from point "a" to the position control position at point "b" to provide soft brake processing. At the beginning of this change-over, as seen in FIGS. 19(*a*) and 19(*b*), the position deviation is zero and therefore torque is also zero. Shortly thereafter, because of the machine load, for example, the needle attempts to fall from top to bottom. Due to the coupling that exists, this also causes the motor 2 to move in a similar fashion, whereby a change occurs in the pulse signals A, B from the encoder 15. This change is converted by the position detection section 17 into a value with a sign related to the rotation direction, i.e., a position feedback signal which is a positive value for forward rotation or a negative value for reverse rotation, and is output to the position control section 18. The position control section 18 integrates this position feedback signal, converts it into a value representative of the position deviation from a home position immediately after the stop of the sewing machine 1, and outputs the result of the conversion. The position/velocity conversion section 20 inverts the sign of this output, converts the output into a velocity command value, and outputs the result of conversion to switch terminal "b". Thereafter, the motor 2 is driven to generate torque to return the sewing machine 1 to the home position as earlier described in the operation of the sewing machine.

A case where a position displacement has further occurred hereafter will now be described. This is a part wherein as described previously, the position deviation in excess of the set value is cleared so that the worker can shift the needle position of the sewing machine 1 by hand. When the position deviation, which is generated by the integration of the position feedback in the position control section 18 as described previously, has exceeded an optional first set value P, e.g., a travel of 5 degrees on the motor shaft, the position control section 18 clears the position deviation to zero. Accordingly, the torque is also zeroed (point h in FIG. 19(*a*)).

The relationships between the travel and torque at that time are shown in FIGS. 19(*a*) and 20(*a*). It should be noted that the value of +P shown in FIGS. 19(*a*) and 20(*a*) is a set value in excess of which the position deviation is cleared as described previously. Also, –T in FIGS. 19(*b*) and 20(*b*) indicates the holding force that exists at a time when the position deviation has exceeded the set value of +P and its value is a maximum torque value. In the meantime, a set value of –P and maximum holding force of +T, (which will not be described here, but are indicated by alternate long and short dash lines in the drawings) will exist when the sewing machine 1 is operated in the opposite direction. Region A shown in FIG. 19(*a*) indicates an interval from when the position deviation is zero until it is cleared, i.e., an interval from zero holding force to the maximum torque value.

As is indicated by the fact that the sewing machine 1 can be turned by hand, the machine load generally is smaller than the force required for moving the sewing machine 1 by hand, and moves the sewing machine 1 comparatively slowly. On the other hand, when the sewing machine 1 is moved by hand, the sewing machine 1 moves faster than when it is moved under the machine load.

On the basis of the explanation provided above, FIG. 20(*b*) can be seen to illustrate the case where the sewing machine 1 is moved fast at constant velocity and corresponds to the manual movement of the sewing machine 1. Similarly, FIG. 19(*b*) shows the case where the sewing machine 1 is moved slowly at constant velocity and corresponds to the movement of the sewing machine 1 under machine load. It should be noted that, since the machine load is smaller than the force required for manually moving the sewing machine 1 as described previously and the value of maximum torque –T of the holding force is actually set to balance them at a stop in region A. Unlike the case illustrated in FIG. 19(*a*), the region A is not exceeded (actually, the sewing machine stops at a position like point "j" with the holding force and the machine load balanced). FIG. 19(*a*) shows an operation wherein the region A has been exceeded; this may be referenced later for the purpose of a comparison between the conventional art and the embodiment of the present invention (a portion indicated by an alternate long and two short dashes line in FIG. 19).

The torque limiter 13 will now be described. FIG. 21 shows the characteristic of the torque limiter 13. In this drawing, the torque is limited to keep it from exceeding the maximum torque value (–T) of the holding force in the reverse direction when the velocity has a positive value (forward rotation), and the torque is limited to keep it from exceeding the maximum torque value (+T) of the holding force in the forward direction when the velocity has a negative value (reverse rotation).

The operation of the position control section 18 will now be described in accordance with a flowchart in FIG. 22. First, when the soft brake processing is initiated, the operation starts in step 50 and the position deviation is cleared in step 60. Then, in step 70, the value of the position feedback is added to the position deviation. Here, the operation will be described for a case where the sewing machine 1 has moved slowly, as shown in FIGS. 19(*a*) and 19(*b*). Since the value of the position deviation is small at first, the value of the position deviation is output in step 100 and the execution returns to step 70. As the execution passes step 70 several times, the position deviation value increases, a judgement is made in step 80 to branch to step 110, and the position deviation value is cleared by the processing of step 110. This is point "h" in FIG. 19(*a*). Hereafter, the same processing is repeated again. If, for example, the sewing machine 1 does not move, the position feedback value is zero and therefore the position deviation value does not change. Accordingly, the processing of step 110 is not performed either. It should be noted that when the selector switch 11 is changed over to point "a" to enter the operation mode, the processing in FIG. 22 is terminated forcibly and operation processing is then performed.

As described above, while the holding force which keeps the sewing machine 1 from being moved under machine load was provided in the conventional sewing machine drive apparatus, the position deviation was cleared if the travel, or the optional first set value P, was exceeded, whereby the worker could shift the needle position by hand.

It is to be understood that in such holding force control, typically, the operation of the soft brake can be controlled by a switch incorporated in the control box 8.

In the conventional sewing machine drive apparatus designed as described above, its holding force (torque) is controlled according to only the position deviation. Hence, whether the force for moving the sewing machine is machine load or worker power, the holding force (torque) was generated similarly in response to the position deviation. In addition to the power for moving the sewing machine by hand, therefore, the worker was further required to have the power to withstand the resistant force (holding force) from the motor. Moreover, since some sewing machines require an extremely large force to begin a movement, the maximum torque value of the holding force must be increased to keep the sewing machine from moving, whereby the resistant torque from the motor is increased. This poses a problem in the stitching world where there are many female workers.

Also, the worker is required to provide the power found by multiplying the holding force (torque), which is generally controlled to be constant on the shaft of the drive apparatus, by the pulley ratio of the sewing machine pulley diameter to the motor pulley diameter, because the worker actually applies the power to the sewing machine pulley to shift the needle position and the motor and the sewing machine are coupled by the motor pulley, the belt and the machine pulley as described previously. Hence, the worker is required to have the physical strength greater than that required when, for example, the motor pulley diameter was reduced for a low-speed sewing machine.

Furthermore, whether the sewing machine moves or not, a current flows during the soft brake processing exercised during a stop, whereby excitation noise is generated. Accordingly, even though the sewing machine is at a stop, the excitation noise of the motor continues to be generated, causing some workers to feel uncomfortable. For this reason, the soft brake had better be operated only when it is required, i.e., only when the sewing machine has moved under machine load after a stop. However, the worker had to make preparations and other work for the next stitching during the stop of the sewing machine and could not watch the sewing machine to turn on the soft brake switch when the sewing machine moved, whereby the soft brake had to be applied automatically.

In view of the aforementioned problems, a first object of the present invention is to provide a sewing machine drive apparatus which exercises control to generate a holding force during a stop of a sewing machine whereby a large holding force is provided under machine load; moreover, the holding force is kept from increasing so that a worker will not become fatigued when such worker must turn the sewing machine by hand.

A second object of the present invention is to provide a sewing machine drive apparatus which allows the sewing machine to be moved with predetermined force independently of the pulley ratio of the pulley diameter of the drive unit, such as a motor, to that of the sewing machine.

SUMMARY OF THE INVENTION

A sewing machine drive apparatus and method concerned with a preferred embodiment involves a drive apparatus which is capable of driving a sewing machine at a controlled velocity, a detector for detecting the rotary position and/or velocity of the output shaft of the drive apparatus, a control unit for controlling the speed of the drive apparatus according to a velocity command value, a holding force generating unit which generates a holding force during a stop of the sewing machine, and a holding force changing unit which changes the holding force generated by the holding force generating unit according to the speed of the drive apparatus or the sewing machine.

In a sewing machine drive apparatus and method concerned with another embodiment, the holding force changing unit changes the holding force generated by said holding force generating unit according to the pulley ratio defined by the pulley diameter of the drive apparatus and the pulley diameter of the sewing machine.

In a sewing machine drive apparatus and method concerned with a further embodiment, the holding force changing unit reduces the intensity of the holding force when a position deviation from a stop position exceeds a set value.

A sewing machine drive apparatus and method concerned with yet another embodiment utilizes a holding force changing unit which controls the holding force only after detection of a predetermined amount of motion of the drive apparatus or sewing machine.

DESCRIPTION OF THE PREFERRED EMBODIMENTS

In the sewing machine drive apparatus in accordance with a preferred embodiment of the invention, a worker can move the sewing machine with small force when the worker attempts to move it by hand.

In the sewing machine drive apparatus in accordance with another embodiment of the invention, the force required for the worker to move the sewing machine by hand is not influenced by the pulley ratio.

In the sewing machine drive apparatus in accordance with a further embodiment of the invention, the intensity of the holding force generated to keep the sewing machine from moving during the stop of the sewing machine is reduced when the position deviation from the stop position increases.

In the sewing machine drive apparatus in accordance with yet another embodiment of the invention, the control of the holding force generated to keep the sewing machine from moving during the stop of the sewing machine is exercised on detection of the motion of the drive means, e.g., a motor, or the sewing machine.

Figure 1:
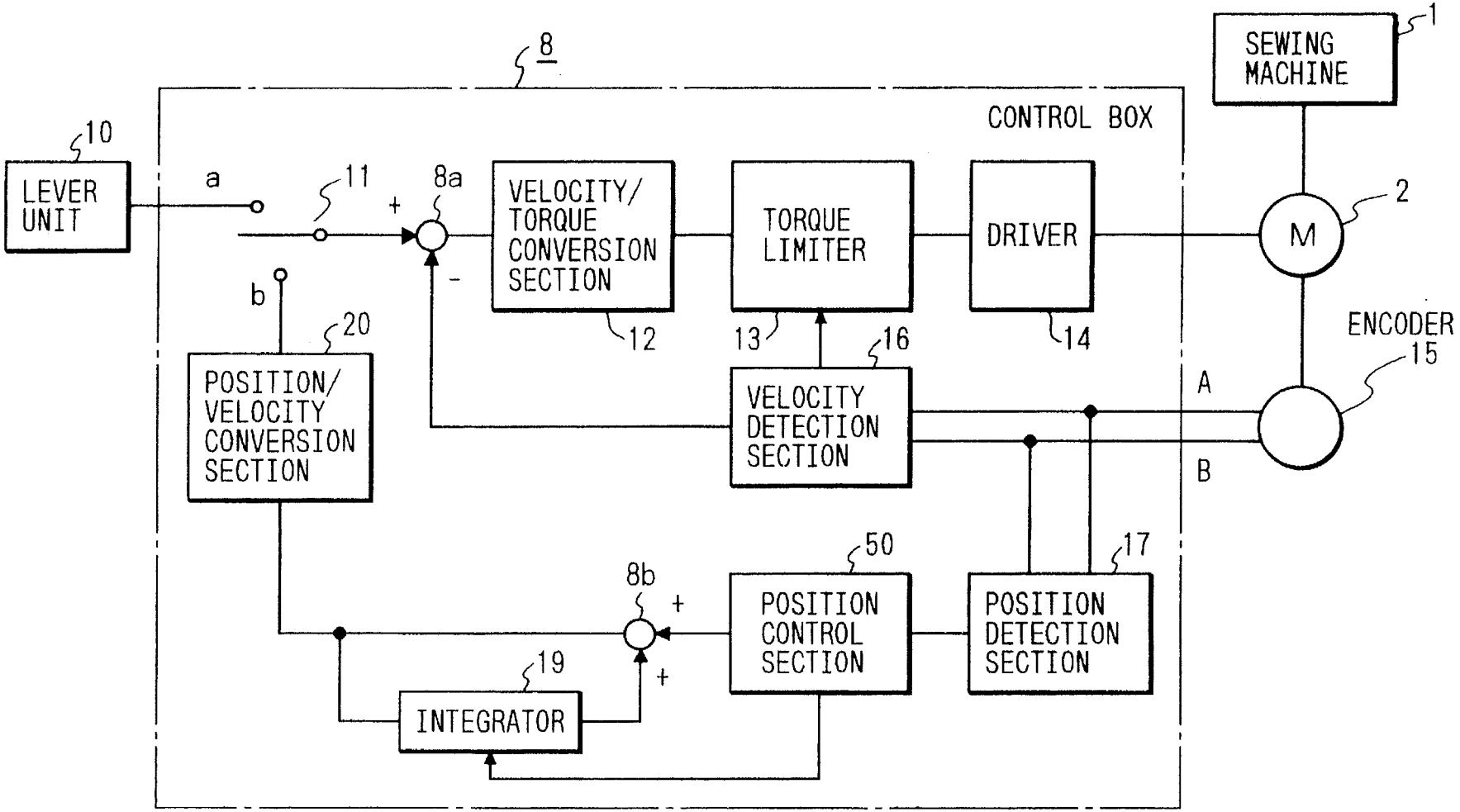
FIG. 1 is a block diagram illustrating the arrangement of a sewing machine drive apparatus according to a preferred embodiment of the invention.
Figure 17A:
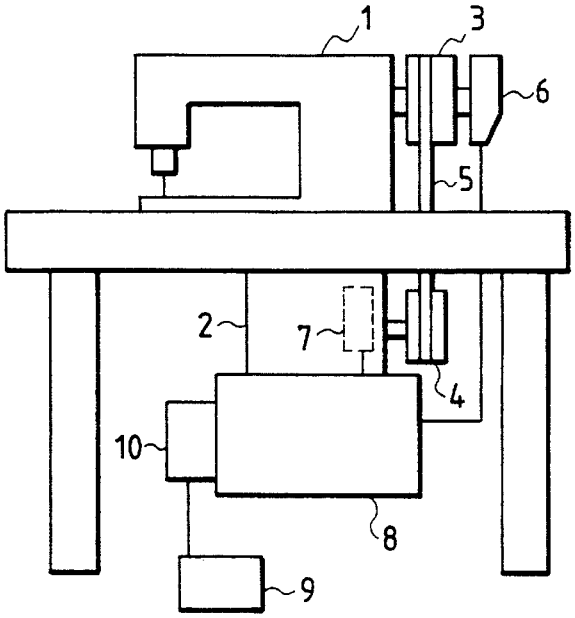
FIGS. 17(*a*) and 17(*b*) illustrate the arrangement of a sewing machine and operation performed due to machine load as viewed from a machine pulley.
Figure 17B:
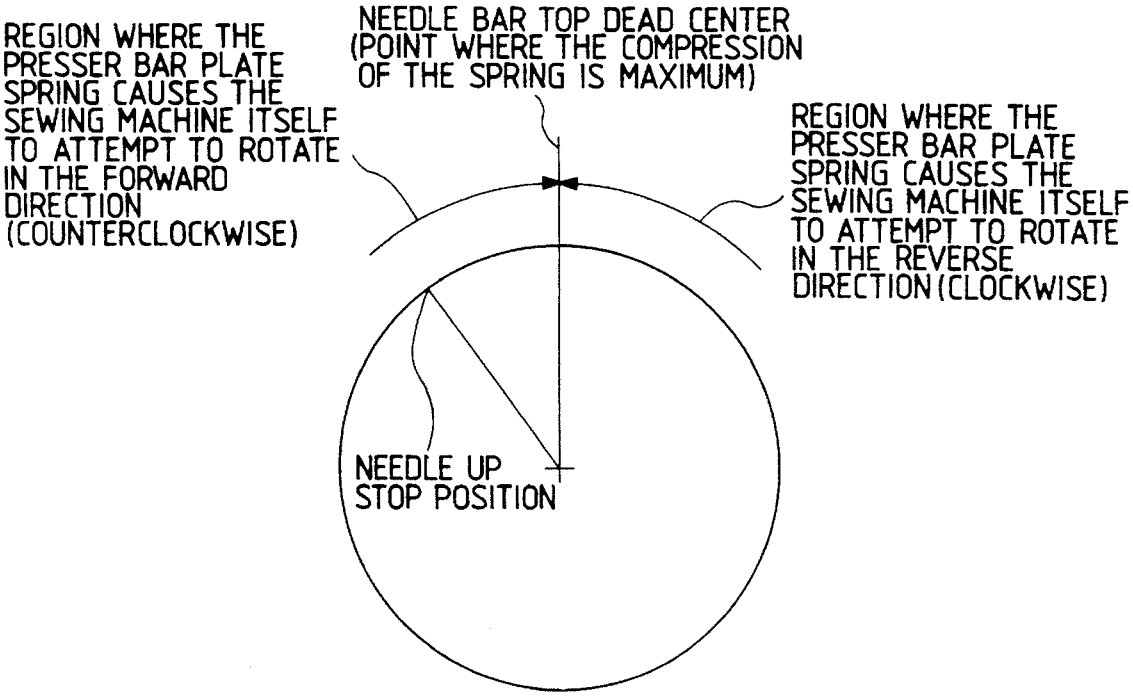
Figure 18:
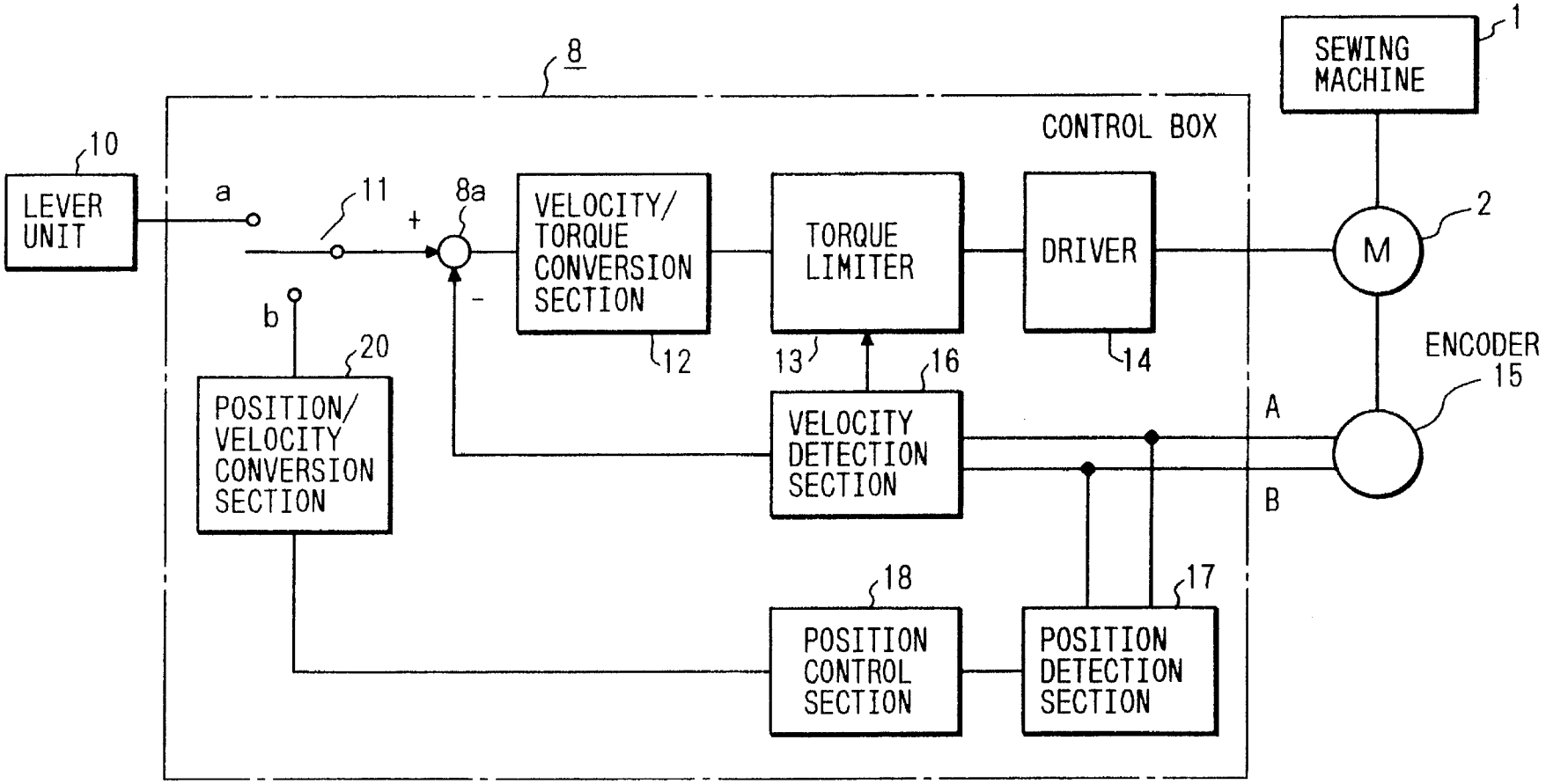
FIG. 18 is a block diagram illustrating the arrangement of a sewing machine drive apparatus known in the conventional art.

A first embodiment of the present invention will now be described in accordance with FIGS. 1, 2(*a*), 2(*b*), 17(*a*) and 17(*b*). FIG. 1 is a block diagram of a sewing machine drive apparatus according to the first embodiment of the present invention and FIGS. 2(*a*) and 2(*b*) show a relationship between position deviation and torque. The arrangement in FIG. 1 has an integrator 19, in addition to the arrangement of the conventional apparatus described in FIG. 17(*a*). The integrator 19 is controlled by the position control section 50. Accordingly, only the operations of the integrator 19 and the position control section 50 will be described in the following explanation.

First, when the sewing machine 1 comes to a stop, the selector switch 11 is changed over from point "a" to the position control position at point "b" in FIG. 1 to provide soft brake processing. When the sewing machine 1 moves under machine load, the position control section 50 calculates the position deviation using the position feedback output by the position detection section 17 and outputs the resultant position deviation to the integrator 19. The integrator 19 integrates this position deviation in terms of time and outputs the result of the integration to the position/velocity conversion section 20. The position/velocity conversion section 20 inverts the sign of this output, converts the output into a velocity command value, and outputs the result of this conversion, whereby the motor 2 is driven to generate a torque to return the sewing machine 1 to the home position.

A case where position deviation has further occurred hereafter will now be described. In this first embodiment, the position deviation in excess of the optional first set value P is cleared to zero by the position control section 50 as in the conventional apparatus. However, it should be noted in the present embodiment apparatus that when the position deviation is cleared to zero, the position control section 50 further outputs a command to halve the value of the integrator 19 in order to ensure smooth rotation. This command causes the integrator 19 to halve the value having been integrated until then, whereby the output from the integrator 19 is also halved and therefore the torque is also halved (point "a" in FIG. 2(*a*)). If a position displacement has further occurred, the position deviation increases again and the value of the integrator 19 also increases, whereby the torque also increases. It is to be understood that the torque is saturated at a predetermined value because it is limited by the torque limiter 13.

Figure 3:
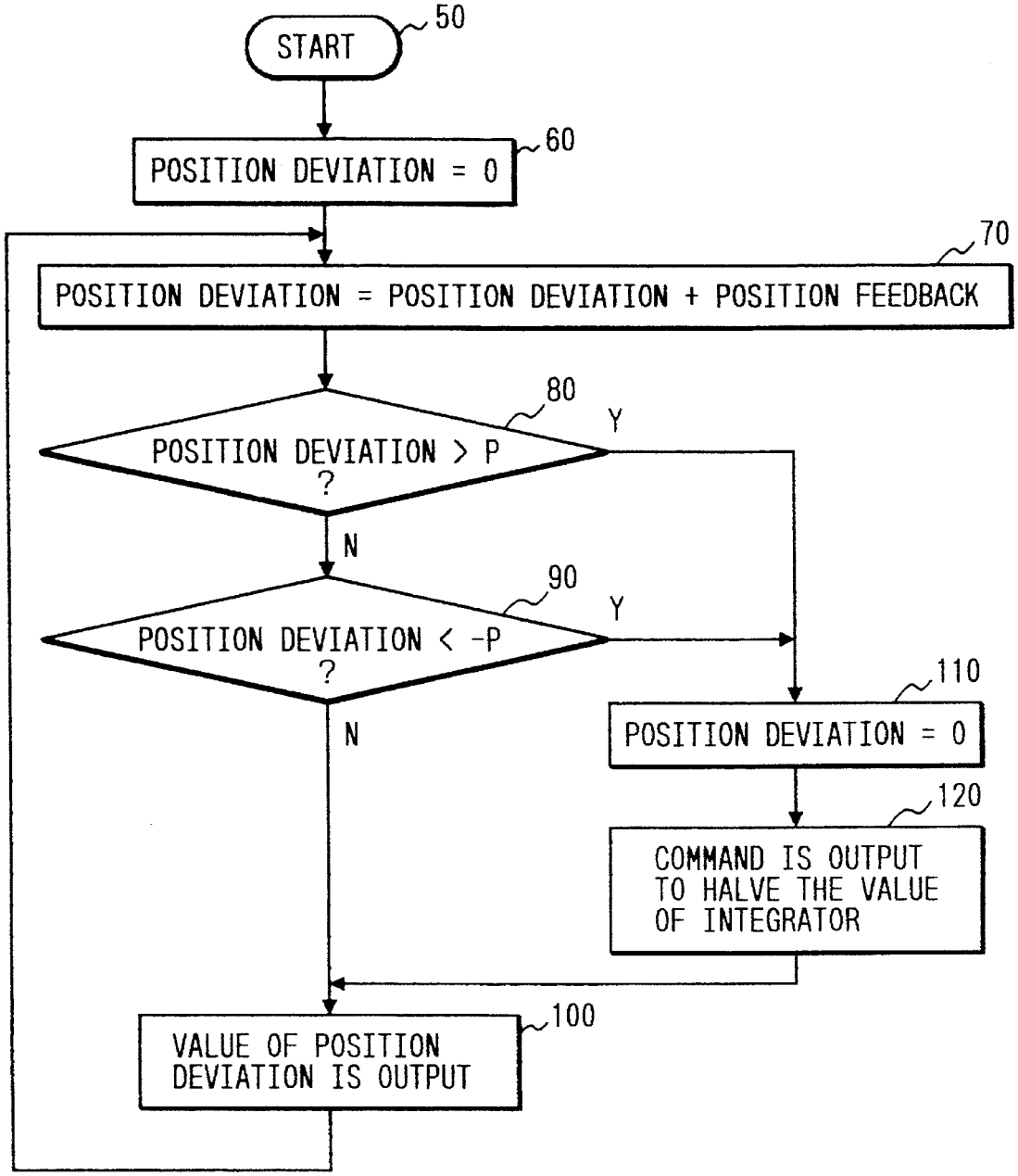
FIG. 3 is a flowchart illustrating the operation of a position control section according to the first embodiment of the invention.
Figure 22:
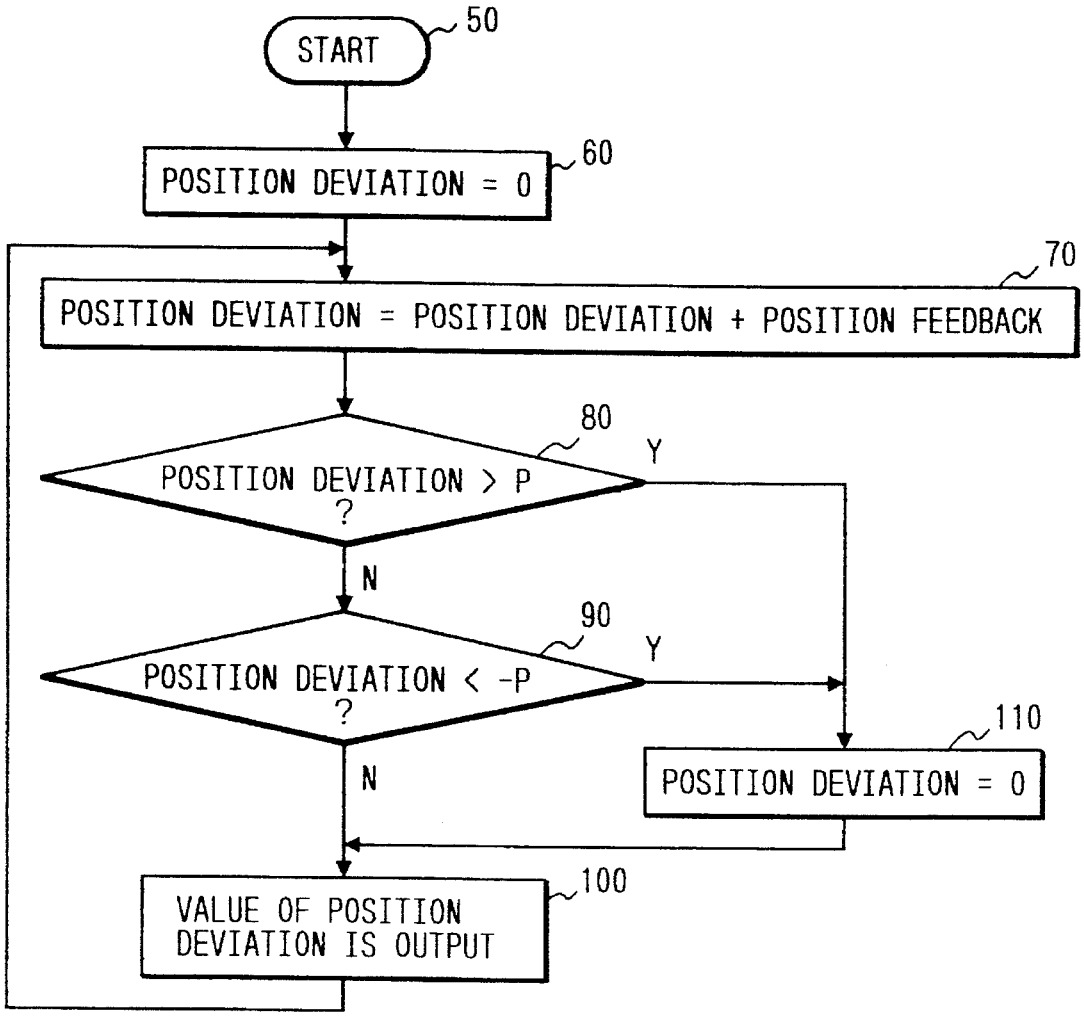
FIG. 22 is a flowchart illustrating the operation of a position control section in the conventional apparatus.

The operation of the position control section 50 will now be described in accordance with a flowchart in FIG. 3. This flowchart has the processing of step 120 in addition to the flowchart in FIG. 22 described in the conventional art. Hence, there has been added only the operation of outputting the command to halve the value of the integrator 19 after the position deviation in excess of the optional first set value P has been cleared in step 110. This processing halves the torque when the position deviation has exceeded the optional first set value P as described previously.

While FIG. 2(*a*) shows that the sewing machine 1 has been moved slowly to correspond to FIG. 19(*a*) described in the conventional art, the operation of the sewing machine 1 moved fast to correspond to FIG. 20(*a*) will now be described in accordance with FIG. 4(*a*). Although the operation of the sewing machine 1 moved fast is fundamentally identical to the operation of the sewing machine 1 moved slowly, the position deviation exceeds the set value before the integration value of the integrator 19 increases (point "b" in FIG. 4(*a*)) and the integration value of the integrator 19 is halved, whereby the integration value of-the integrator 19 is kept from being increased. Accordingly, the value of the torque generated by the output of the integrator 19 is smaller than the value provided when the sewing machine 1 is rotated slowly. When there is a comparison between point "a" in FIG. 2(*a*) and point "c" in FIG. 4(*a*), an overall value integrated by the integrator 19, which is found by (position deviation * time/2), is equal in both FIGS. 2(*a*) and 4(*a*), but the number of times when the integration value of the integrator 19 has been halved is 8 in FIG. 4(*a*) and is 1 in FIG. 2(*a*). This difference in the number of times when the integration value of the integrator 19 has been halved will cause the torque generated in FIG. 2(*b*) to be smaller than that in FIG. 4(*b*).

Because the increase in the number of times during a predetermined length of time keeps the torque from increasing, and also because the number of times increases as the rotating velocity of the sewing machine 1 increases, the intensity of the torque in the apparatus shown in the present embodiment changes in response to the rotating velocity of the sewing machine 1.

Figure 2A:
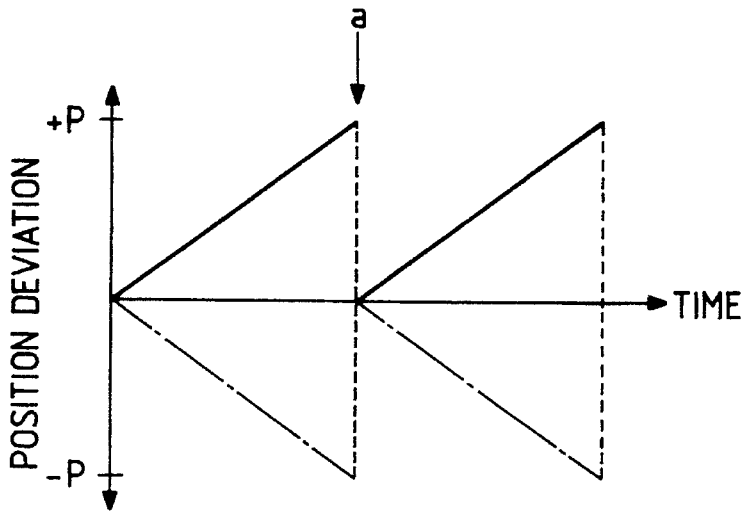
FIGS. 2(*a*) and 2(*b*) illustrate a relationship between position deviation and torque according to a first embodiment of the invention.
Figure 2B:
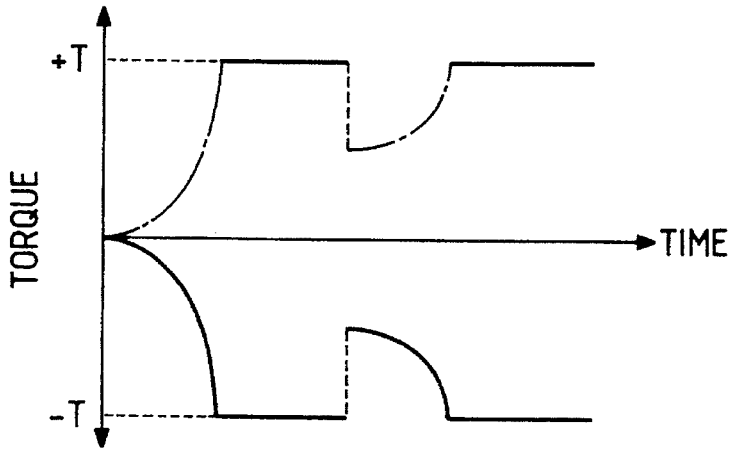
Figure 4A:
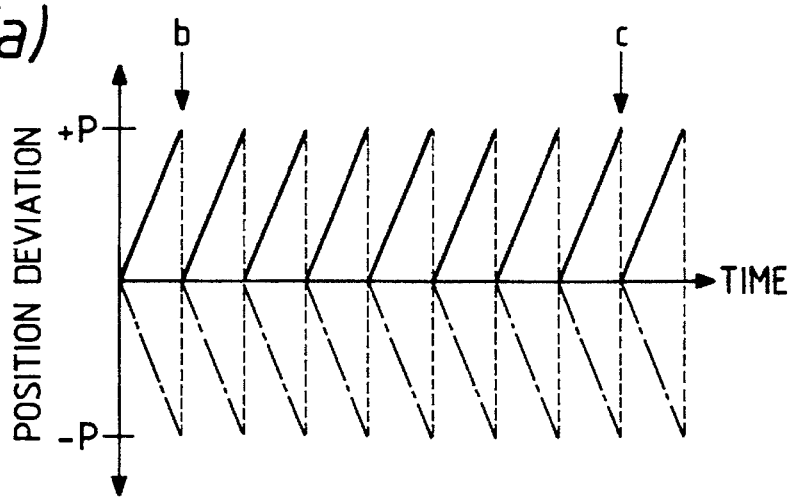
FIGS. 4(*a*) and 4(*b*) illustrate a relationship between position deviation and torque according to the first embodiment of the invention.
Figure 4B:
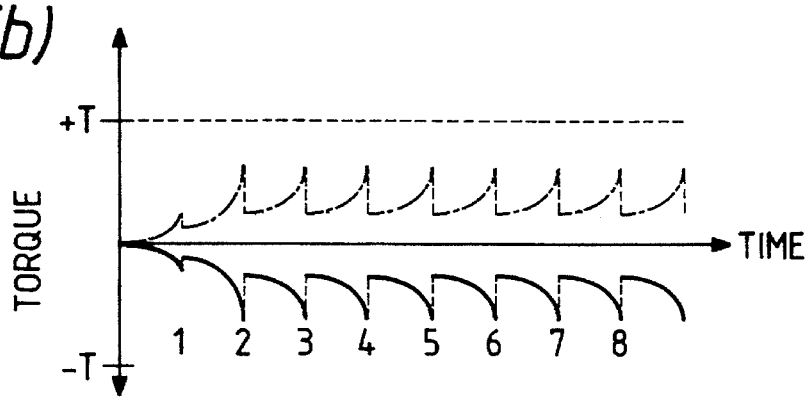
Figure 19A:
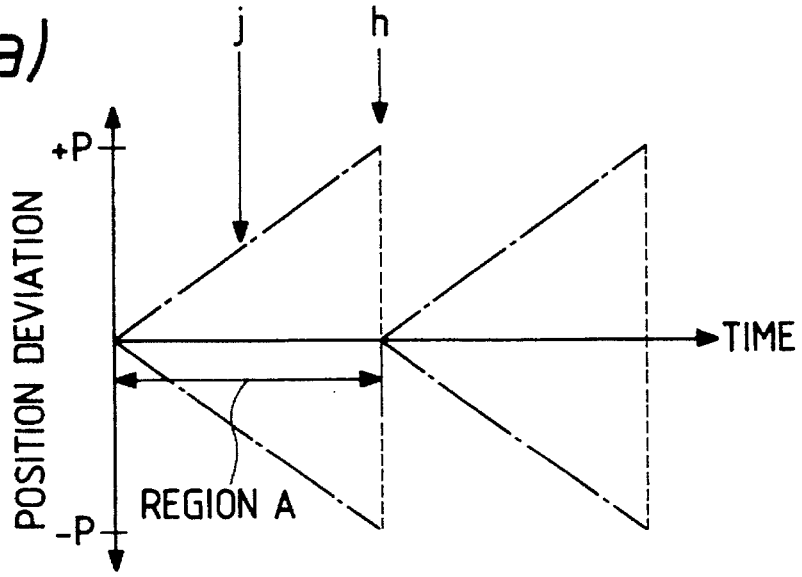
FIGS. 19(*a*) and 19(*b*) illustrate a relationship between position deviation and torque according to the conventional apparatus.
Figure 19B:
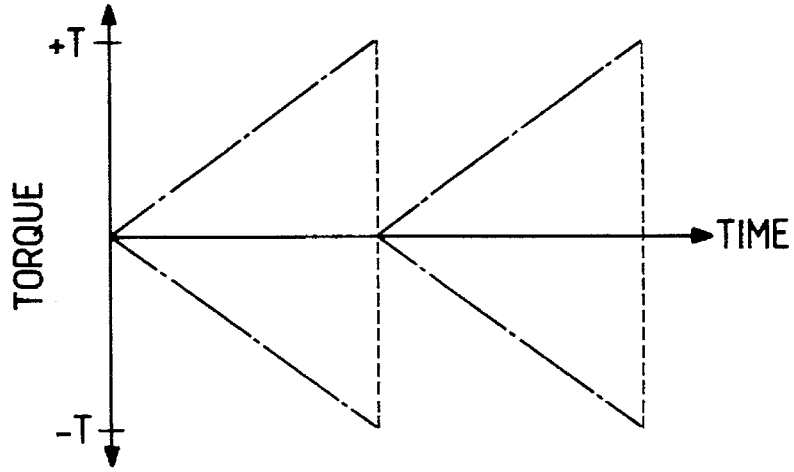
Figure 20A:
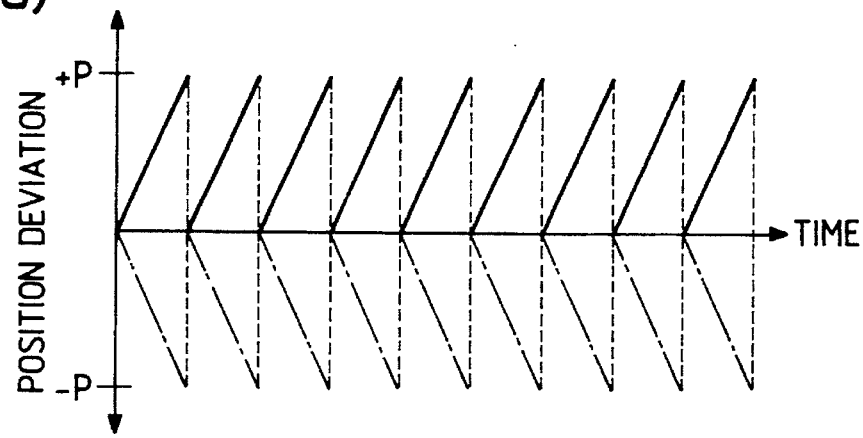
FIG. 20(*a*) and 20(*b*) illustrate a relationship between position deviation and torque according to the conventional apparatus.
Figure 20B:
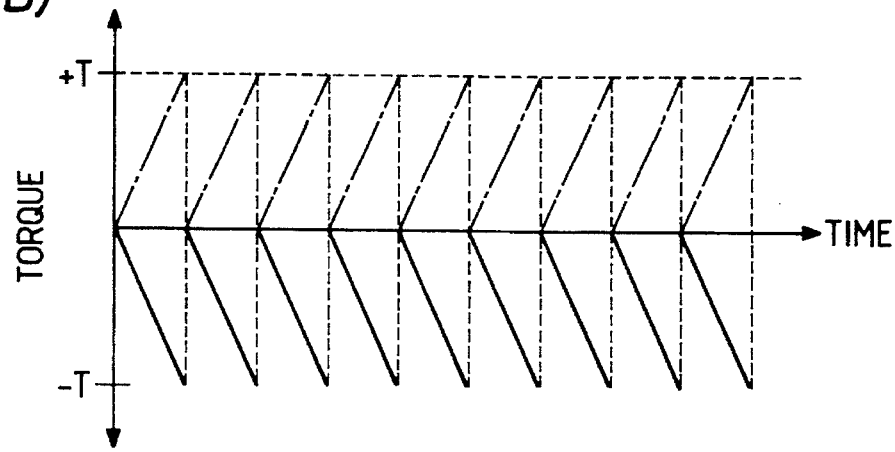

While a comparison between FIG. 2(*b*) and FIG. 19(*b*) (when the sewing machine has moved under machine load) indicates that average torque generated is approximately equal or larger in FIG. 2(*b*), a comparison between FIG. 4(*b*) and FIG. 20(*b*) (when the sewing machine is moved by hand) indicates apparently that the average torque is smaller in FIG. 4(*b*). As described above, the torque generated by the motor 2 when the worker attempts to rotate the sewing machine 1 by hand is smaller in the present embodiment than in the conventional apparatus, whereby the sewing machine 1 can be moved easily.

The position deviation in excess of 5 degrees on the motor shaft was designed to be cleared in the preferred embodiment; however, the position deviation in excess of an optional angle, e.g., 5 degrees, on the shaft of the sewing machine 1 may also be cleared to produce the same effects. It should be noted that as this angle is smaller, the feeling of hand-turning the pulley is smoother. Also, while the integration value of the integrator 19 is halved when the position deviation is cleared, the value may be reduced to one-third, cleared, or reduced in any other way to provide the identical effects.

Figure 5:
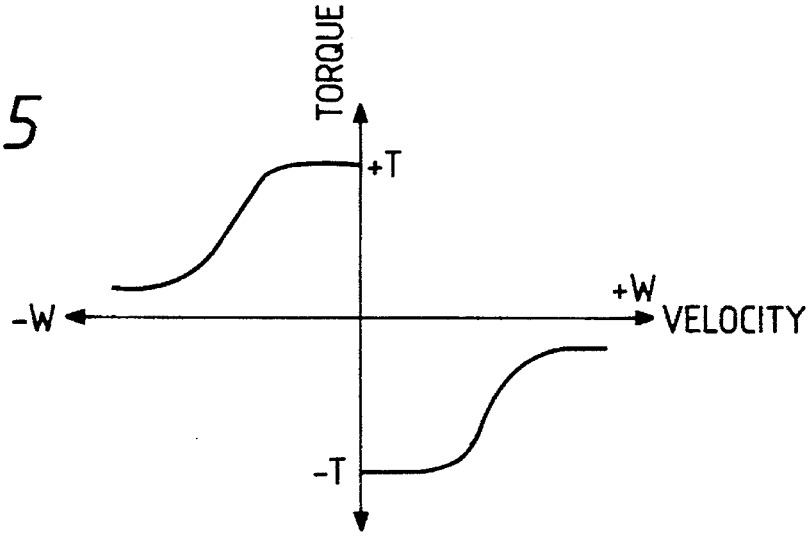
FIG. 5 illustrates a function of a torque limiter according to the first embodiment of the invention.
Figure 21:
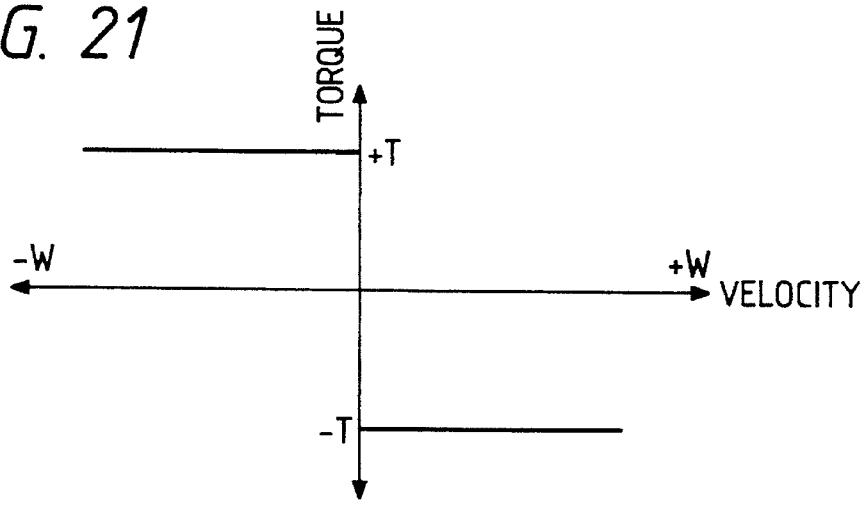
FIG. 21 illustrates the characteristic of a torque limiter employed in the conventional apparatus.

In each of the previous designs, the value of the integrator 19 was halved when the position deviation was cleared to change the torque relative to the velocity of the motor 2 or the sewing machine 1; however, the value of the torque limiter 13 in the present embodiment also may be changed during soft brake processing. In particular, the limiter 13 may be changed from the function as shown in FIG. 21 to a function as shown in FIG. 5 where the maximum torque value is smaller as the rotating velocity of the sewing machine 1 is higher, in order to produce the same effects.

Figure 6:
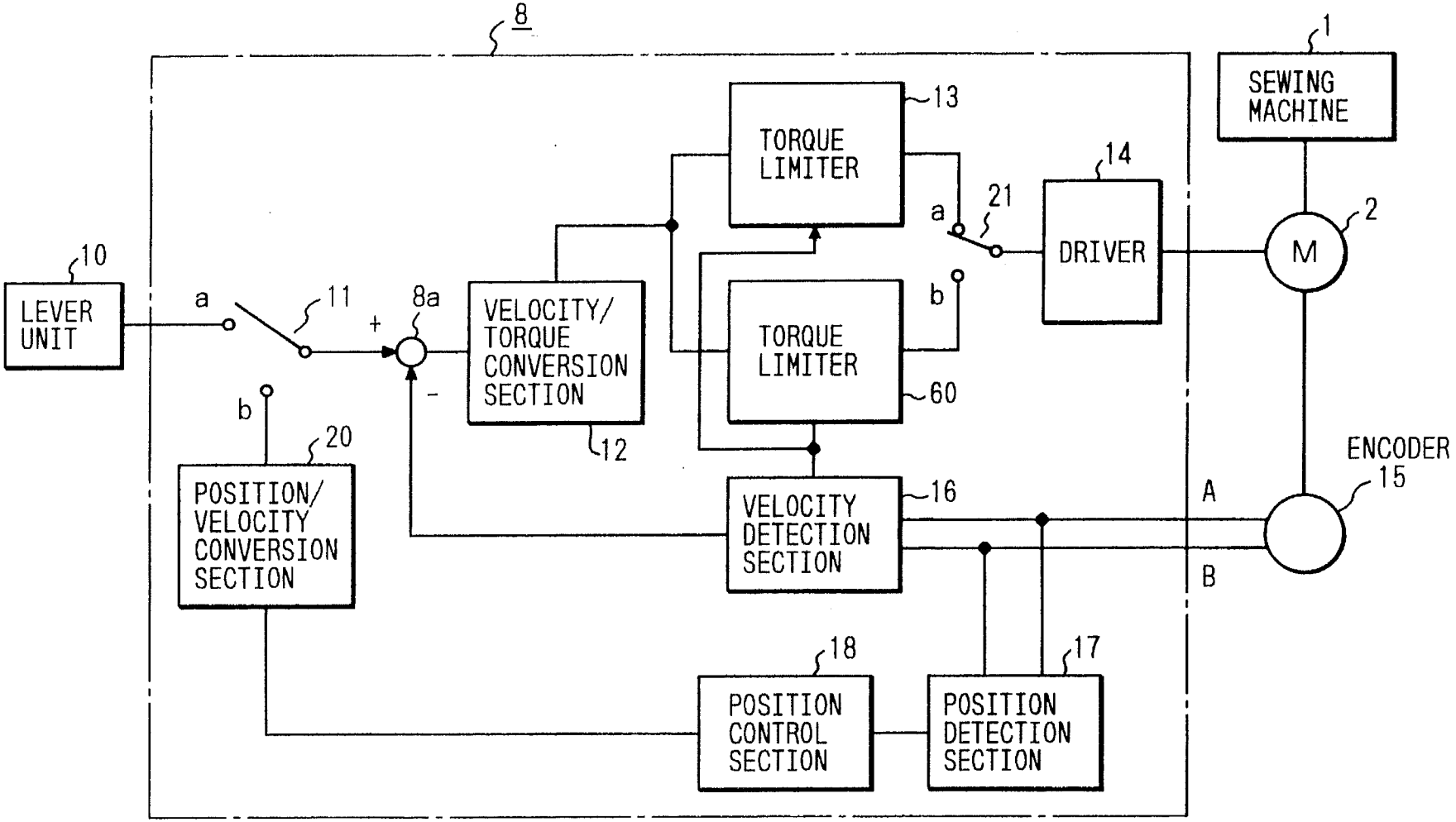
FIG. 6 is a block diagram illustrating the arrangement of a sewing machine drive apparatus according to a second embodiment of the invention.
Figure 7:
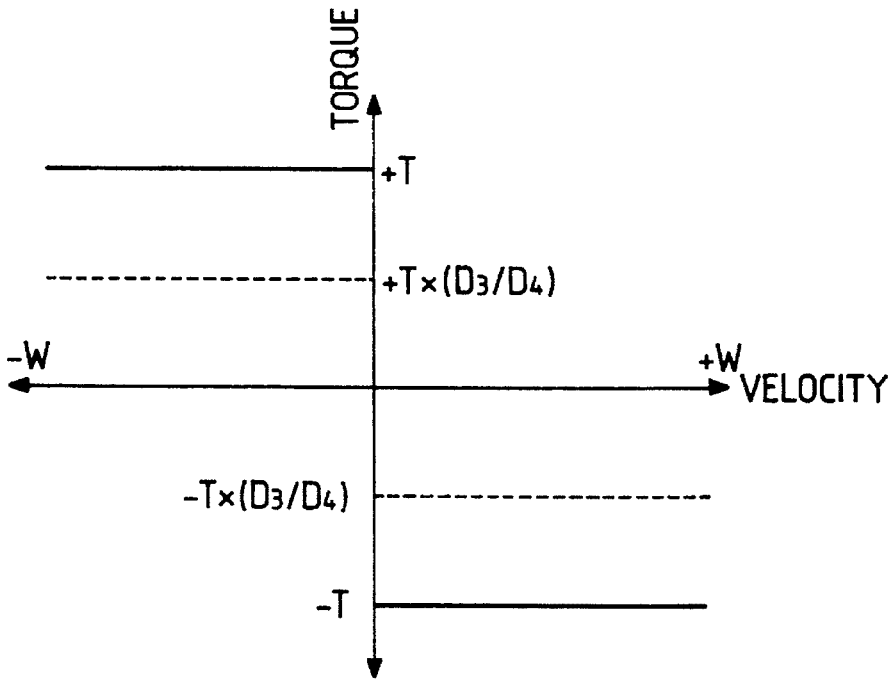
FIG. 7 illustrates a function of a torque limiter according to the second embodiment of the invention.

A second preferred embodiment of the present invention will now be described in accordance with a sewing machine drive apparatus shown in FIG. 6. In the arrangement shown in FIG. 6, the torque limiter 13 in the arrangement described in the conventional apparatus is designed to be switchable between the operation mode and the soft brake mode and the torque limiter in the soft brake mode has been changed for a torque limiter 60 which has a function as shown in FIG. 7. It is to be understood that a switch 21 operates in the same way as the switch 11.

Figure 8A:
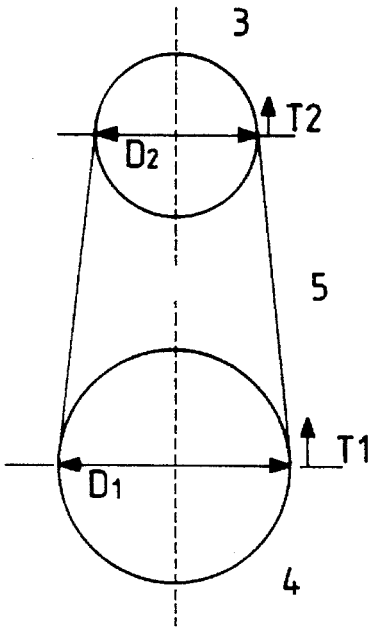
FIGS. 8(*a*) and 8(*b*) illustrate two relationships between a sewing machine pulley and a motor pulley according to the second embodiment of the invention.
Figure 8B:
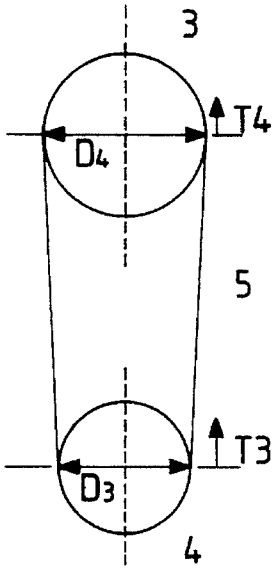

FIGS. 8(*a*) and 8(*b*) are expanded views of a part where the pulley 3 of the sewing machine 1 and the pulley 4 of the motor 2 are coupled by the belt 5 as described in the conventional art. FIG. 8(*a*) shows that the pulley 4 of the motor 2 is larger, and FIG. 8(*b*) shows that the pulley 4 of the motor 2 is smaller than that of the driven pulley 3.

In FIG. 8(*a*), when the motor 2 has generated the holding force=torque T1 during the soft brake process, torque T2 on the pulley 3 of the sewing machine 1 is T2=T1*D2/D1. Similarly, in FIG. 8(*b*), when the motor 2 has generated the holding force=torque T3 during the soft brake process, torque T4 on the pulley 3 of the sewing machine 1 is T4=T3*D4/D3 (where, D1 and D3 indicate the diameters of the motor 2 pulley, and D2 and D4 denote the diameters of the sewing machine 1 pulley). To allow the sewing machine 1 to be moved by constant power at any pulley ratio, the torque on the pulley 3 of the sewing machine 1 may be made constant independently of the pulley ratio. Hence, the values of T1 and T3 may be controlled to make T2 and T4 equal. (Since T1 and T3 in the conventional apparatus were constant on the shaft of the motor 2 because they were limited by, for example, the value of T shown in FIG. 7, T2 and T4 are varied, e.g., T2=T*D2/D1 and T4=T*D4/D3, on the shaft of the sewing machine 1 according to the pulley ratio.)

Accordingly, when a fixed value shown in FIG. 7, e.g., torque value T, is made variable by multiplying it by the pulley ratio, i.e., T1=T*D1/D2, and the assignment of the multiplication result to said expression results in T2=(T*D1/D2)*D2/D1=T. Similarly, T4=(T*D3/D4)*D4/D3=T, and T2=T4=T.

It should be noted that the gain of the position/velocity conversion section 20 must be preset such that the velocity command from the position/velocity conversion section 20 is not less than the value of the torque limiter 60 at any pulley ratio.

Since multiplying the torque value by the pulley ratio as indicated by the broken line in FIG. 7 allows the torque on the sewing machine shaft to be made constant independently of the pulley ratio, the sewing machine 1 can be moved by constant power at any pulley ratio.

While the function of the torque as shown in FIG. 7 was used in the second embodiment, the value of any other function allows the torque on the sewing machine shaft to be controlled independently of the pulley ratio. It should be noted that since some pulley ratios cause a problem, such as heat generated by the motor 2, due to the increased torque value calculated by multiplication, it is effective to preset the torque limiter 60 to a predetermined value.

Figure 9:
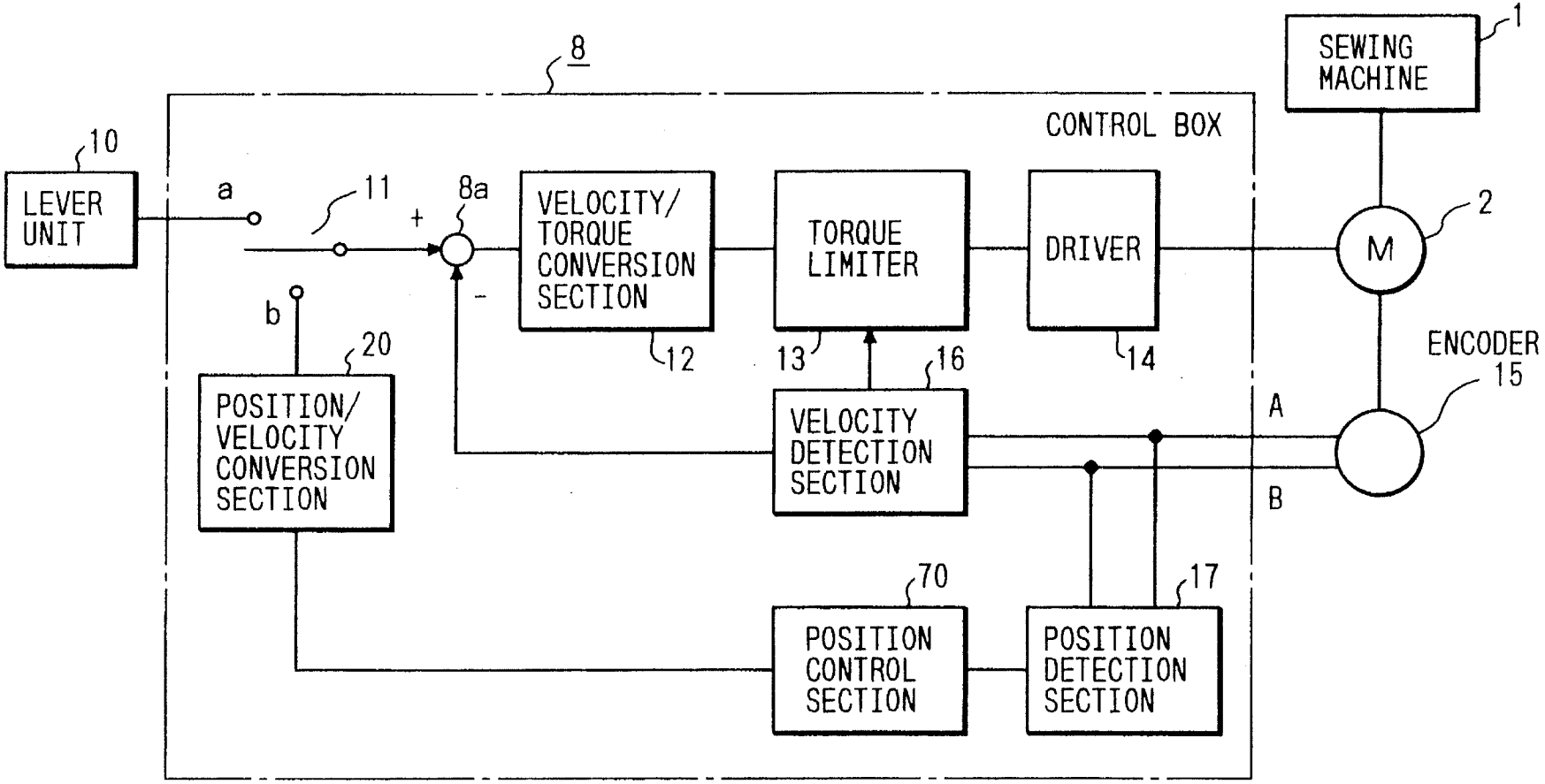
FIG. 9 is a block diagram illustrating the arrangement of a sewing machine drive apparatus according to a third embodiment of the invention.
Figure 10A:
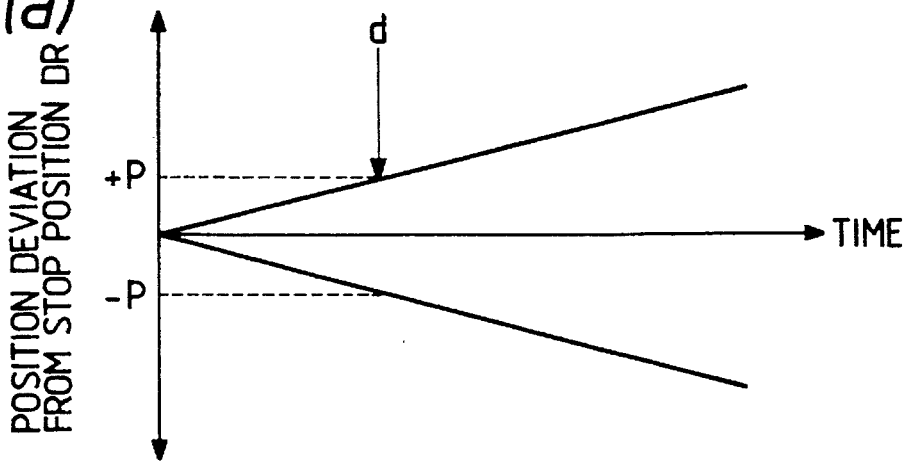
FIGS. 10(*a*), 10(*b*) and 10(*c*) illustrate the relationships between position deviation and torque according to the third embodiment of the invention.
Figure 10B:
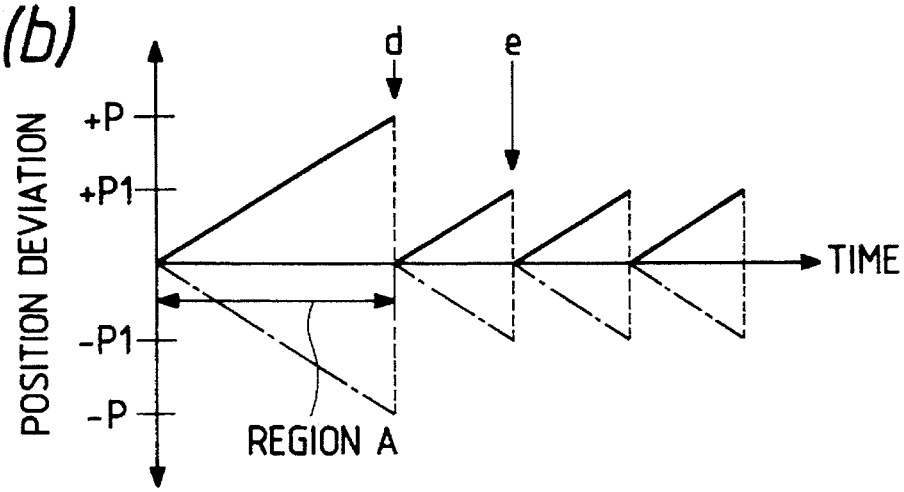
Figure 10C:
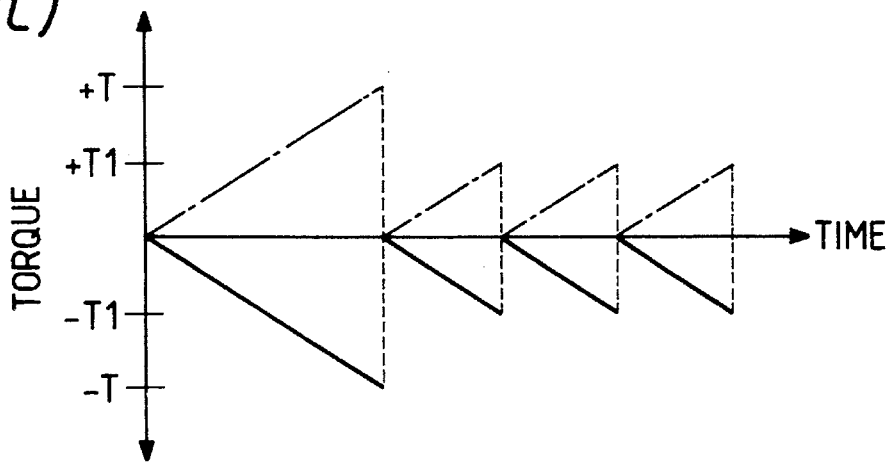

A third embodiment of the present invention will now be described in accordance with FIGS. 9, 10(*a*)–10(*c*), 17(*a*) and 17(*b*). FIG. 9 is a block arrangement diagram of a sewing machine drive apparatus according to the third embodiment of the present invention and FIGS. 10(*a*)–10(*c*) show a relationship between position deviation and torque. It is to be understood that the arrangement shown in FIG. 9 is different from the conventional apparatus in FIG. 17(*a*) only with respect to the use of a position control section 70.

Figure 11:
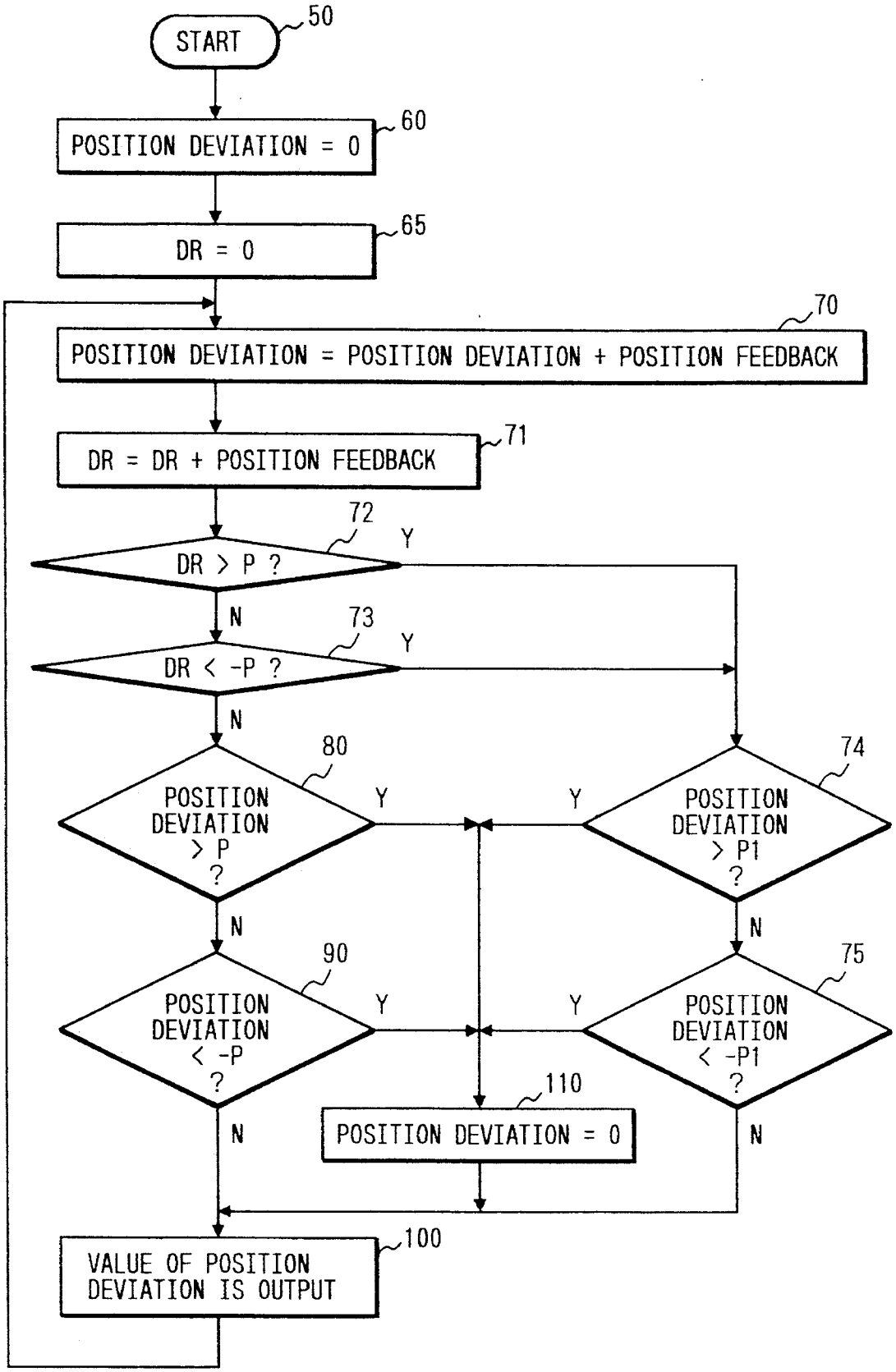
FIG. 11 is a flowchart illustrating the operation of a position control section according to the third embodiment of the invention.

The operation of the position control section 70 will now be described in accordance with a flowchart in FIG. 11. This flowchart has the processing of step 65 and steps 71 to 75, in addition to the flowchart in FIG. 22 which is found in the conventional art.

First, when the soft brake processing is initiated, the operation starts in step 50 and the position deviation is cleared in step 60. Subsequently, in step 65, the position deviation from stop position DR is cleared, as represented in FIG. 10(*a*). It should be noted that the position deviation from stop position DR is a total travel starting at the stop position since it is initialized only once in step 60 at the start of the processing while the position deviation is cleared at points d, e, etc., in FIG. 10(*b*). Then, the value of the position feedback is added to the position deviation in step 70 and the value of the position feedback is also added to the position deviation from stop position DR in step 71. Here, the operation will be described for a case where the sewing machine 1 has moved as shown in FIGS. 10(*a*)–(*c*). Since the value of the position deviation from stop position DR (FIG. 10(*a*)) and the value of the position deviation (FIG. 10(*b*)) are both small at first, the processing proceeds from step 72 to step 73 to step 80 to step 90, the value of the position deviation is output in step 100, and the execution returns to step 70. As the execution passes steps 70 and 71 several times, both the value of the position deviation from stop position DR and the value of the position deviation increase and a judgement is made in step 72 to branch to step 74. Here, since the first set value P is larger than a second set value P1, a judgement is made in step 74 to branch to step 110. With reference to FIGS. 10(*a*) and (*b*), only the position deviation value is cleared by the processing of step 110. This is point d in FIGS. 10(*a*) and 10(*b*). Since the value of the position deviation from stop position DR is not cleared, as seen in FIG. 10(*a*), a further judgement is made in step 72 hereafter to branch to step 74. However, since the position deviation value has been cleared once, the processing of step 110 is not performed until the position deviation value exceeds the second set value P1, and the processing progresses from step 74 to step 75 to step 100. When the position deviation value has exceeded the second lower set value P1, as seen in FIG. 10(*b*), a judgement is made in step 74 to branch to step 110 and the position deviation value is cleared again. This is point e in FIG. 10(*b*). Hereafter, the above processing is repeated again.

As described above, the position control section 70 operates in a region higher than region A to clear the position deviation to zero when a value smaller than the first set value P, e.g., the travel of 2° on the shaft of the motor 2, exceeds the second set value P1. Since the second set value P1 is set to a smaller value than the first set value P, the torque value –T1 at a time when the travel has reached the second set value P1 is also smaller than the maximum torque value –T as a matter of course.

According to the present embodiment apparatus, therefore, the excess of region A at a time when, for example, the sewing machine 1 is hand-turned by the worker to check the position of needle location, reduces the resistant torque from the motor 2, whereby the sewing machine 1 can be moved more easily than in the conventional apparatus.

It will be appreciated that in the present embodiment, the position deviation is cleared within region A when exceeding 5 degrees on the shaft of the motor 2, and is cleared in a region higher than region A when exceeding 2 degrees on the shaft of the motor 2. However, the position deviation may be cleared when exceeding an optional angle on the shaft of the sewing machine 1 to provide the identical effects.

Also, when the sewing machine 1 used can be positioned to a stop at its needle UP or DOWN position under the control of a signal from the needle position detector 6 as described previously, instead of using the angle of the motor 2 or sewing machine, the maximum torque value may be reduced in relation to the signal from the needle position detector 6, e.g., when an UP position signal or a DOWN position signal is switched off (switched off when the sewing machine is offset from the stop position), in order to produce the same effects.

Figure 12:
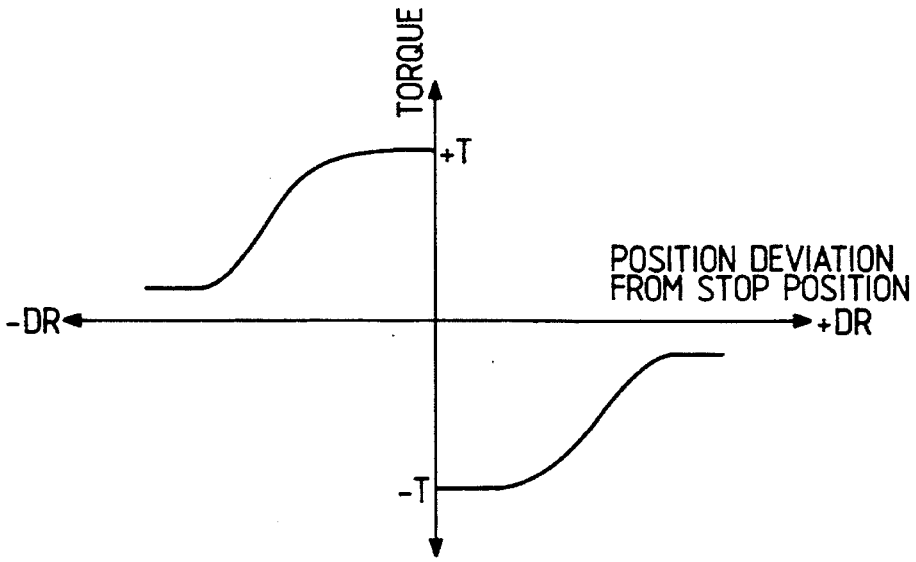
FIG. 12 illustrates a function of a torque limiter according to an alternative third embodiment of the invention.

In the present embodiment wherein the position deviation was cleared when the optional travel of the shaft of the motor 2 was exceeded to change the torque relative to the position deviation, the value of the torque limiter 13 in the present embodiment may also be changed, for example, only during soft brake processing from a function as shown in FIG. 21 to a function as shown in FIG. 12 where the maximum torque value becomes smaller as the position deviation from stop position DR becomes larger, in order to produce the same effects.

Figure 13:
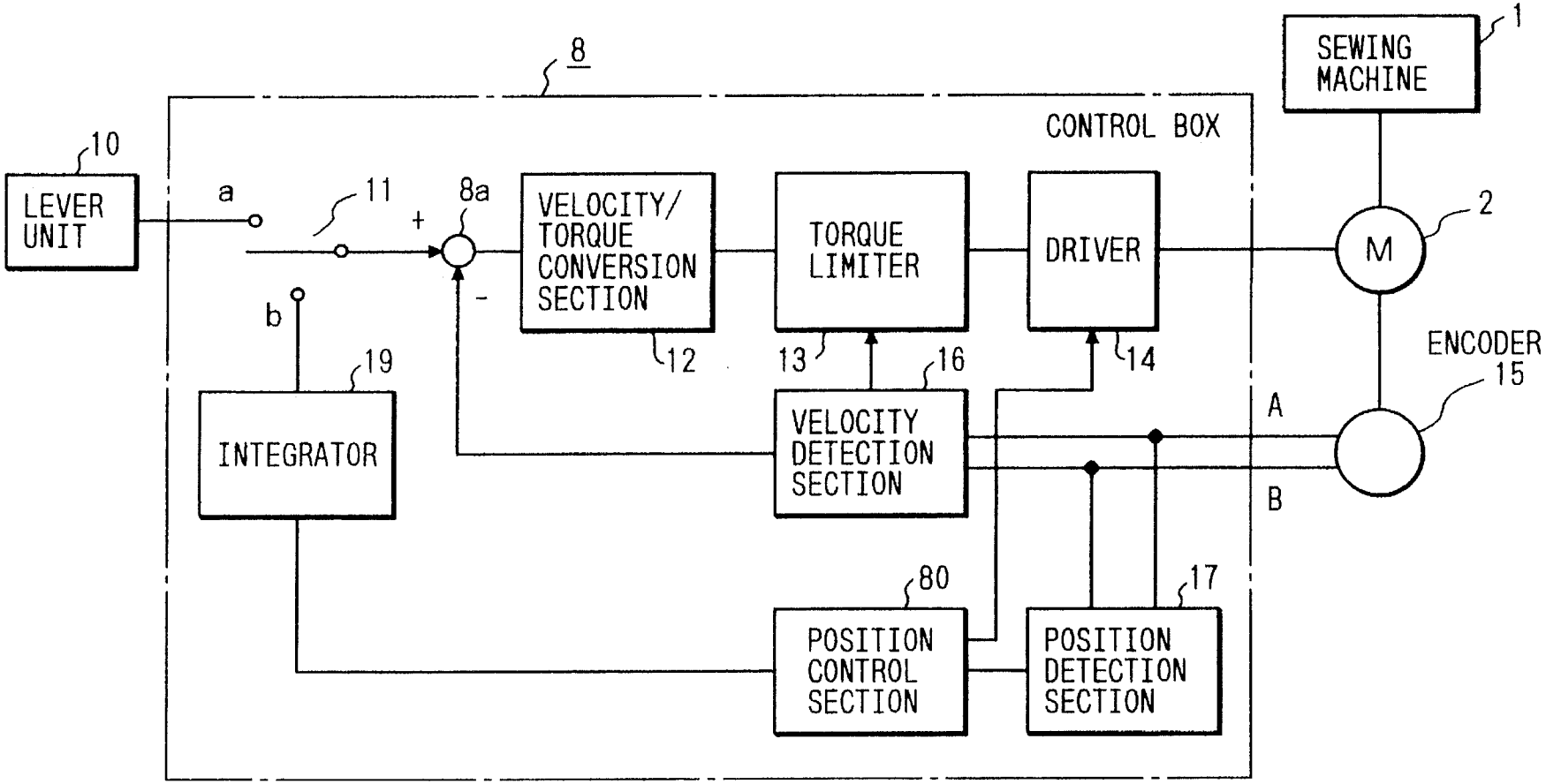
FIG. 13 is a block diagram illustrating the arrangement of a sewing machine drive apparatus according to a fourth embodiment of the invention.
Figure 14:
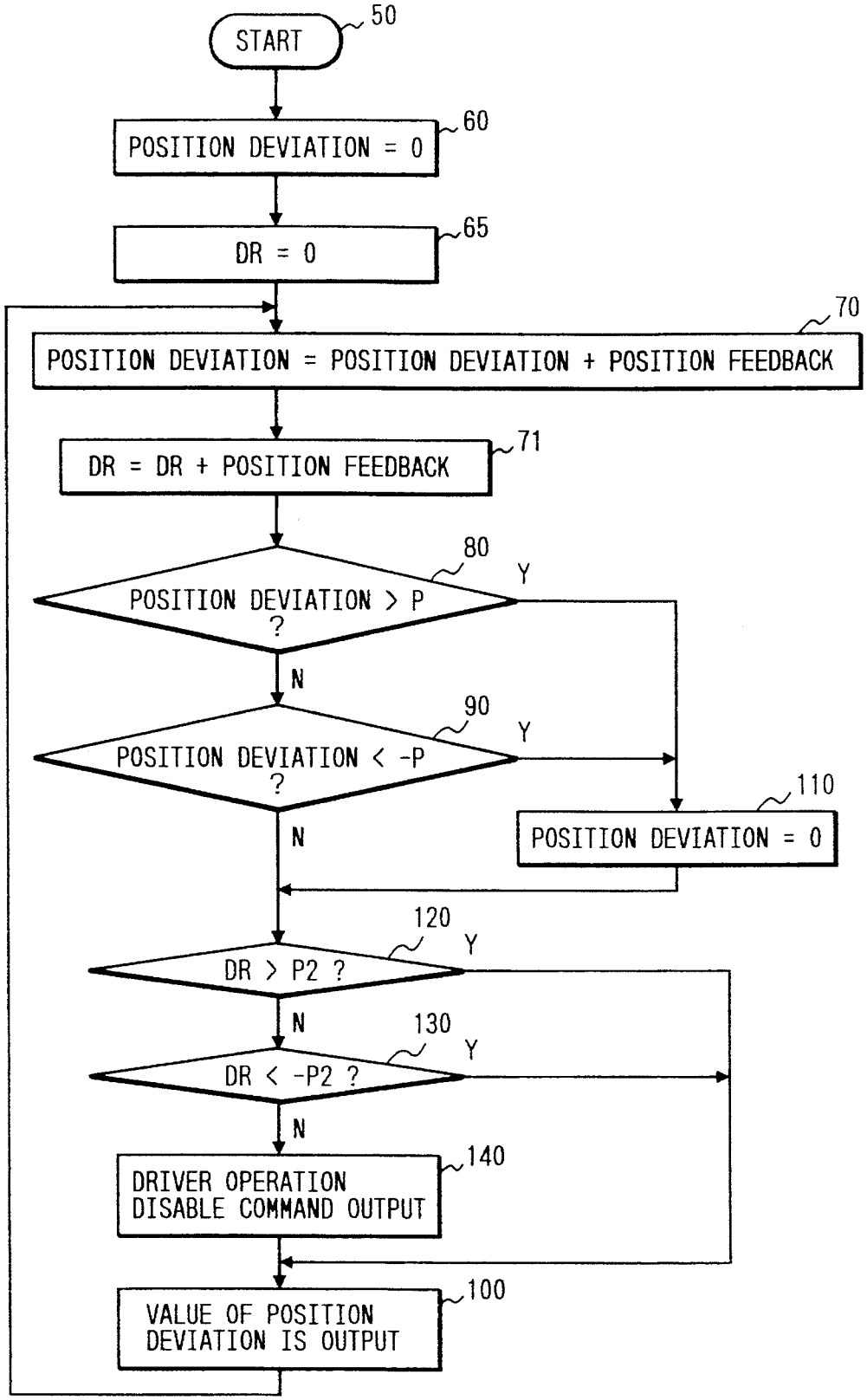
FIG. 14 is a flowchart illustrating the operation of a position control section according to the fourth embodiment of the invention.

A fourth embodiment of the present invention will now be described in accordance with FIGS. 13 and 14. It is to be understood that the sewing machine drive apparatus in the fourth embodiment shown in FIG. 13 is identical to the conventional sewing machine drive apparatus shown in FIG. 17(*a*), with the exception that a position control section 80 can disable the operation of the driver 14. Accordingly, the operation of the present embodiment remains unchanged from the operation described in the conventional art with the exception of the soft brake, and therefore will not be described.

In the present embodiment, the position control section 80 is designed to disable the operation of the driver 14 until the position deviation from the stop position DR exceeds an optional set value, e.g., a travel of 2 degrees on the shaft of the motor 2 or a third set value P2.

Figure 15A:
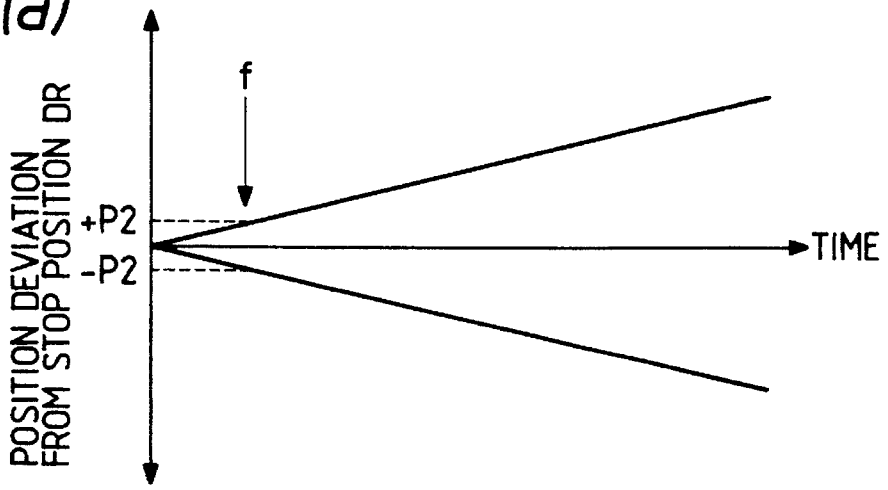
FIGS. 15(*a*), 15(*b*) and 15(*c*) illustrate two relationships between position deviation and torque according to the fourth embodiment of the invention.
Figure 15B:
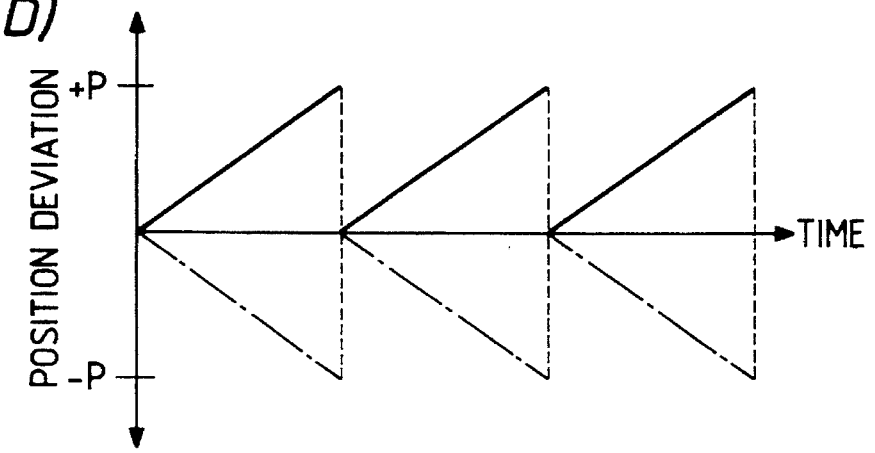
Figure 15C:
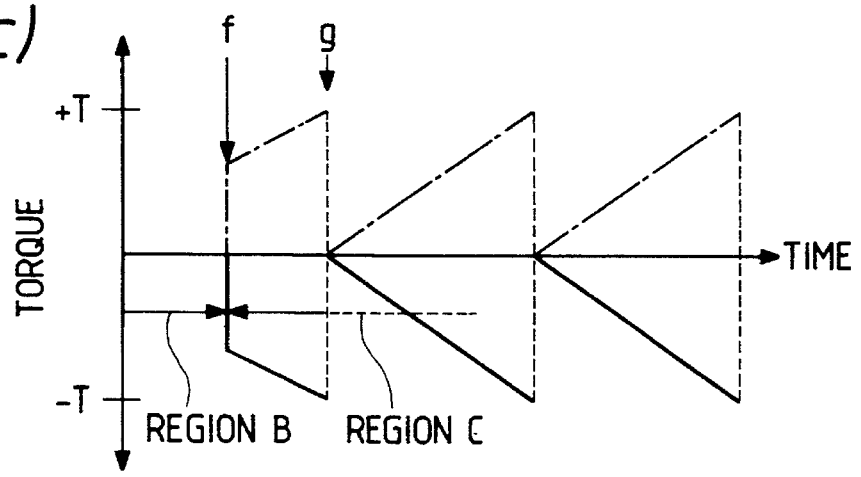

A case where the sewing machine 1 has moved under machine load will now be described in accordance with FIGS. 15(*a*)–(*c*). In FIG. 15(*a*), when the position deviation from the stop position is within the travel of 2 degrees on the shaft of the motor 2 or the third set value P2, soft brake is not operated and therefore the holding force is not generated. Accordingly, as seen in FIG. 15(*c*), the sewing machine 1 exceeds region B shortly and reaches region C.

When the sewing machine 1 has reached region C, the position control section 80 which had disabled the operation of the driver 14 until then, enables the operation of the driver 14. Hence, the driver 14 drives the motor 2 to generate the holding force corresponding to the velocity command value from the position/velocity conversion section 19, i.e., position deviation (a state similar to the case where the soft brake is operated). In region C, therefore, the torque resisting the force of the sewing machine 1 attempting to move is generated to stop the sewing machine 1. A case where a position displacement occurs thereafter is identical to that of the conventional sewing machine drive apparatus and will not be described here.

The operation of the position control section 80 will now be described in accordance with a flowchart in FIG. 14. This flowchart has the processing of step 65, step 71, step 120, step 130 and step 140 in addition to the flowchart in FIG. 22 which is representative of the conventional art. First, when the soft brake processing is initiated, the operation starts in step 50, the position deviation is cleared in step 60, and the position deviation from stop position DR is cleared in step 65. Subsequently, the value of the position feedback is added to the position deviation in step 70 and the value of the position feedback is also added to the position deviation from stop position DR in step 71. Here, the operation will be described for a case where the sewing machine 1 has moved as shown in FIGS. 15(*a*)–(*c*). Since the value of the position deviation from stop position DR and the value of the position deviation are both small at first, the processing proceeds from step 80 to step 90 to step 120 to step 130 to step 140. Since an operation disable command is output to the driver 14 in the processing of step 140, the current does not flow and the torque is zero (in the part of region B as seen in FIG. 15(*c*)).

As the execution passes steps 70 and 71 several times, both the value of the position deviation from stop position DR and the value of the position deviation increase. Since the third set value P2 (FIG. 15(*a*)) is smaller than the first set value P (FIG. 15(*c*)), before reaching P in FIG. 15(*b*), a judgement is made first in step 120 to branch to step 100 when DR>P2. Hence, the processing of step 140 (driver disable command output) is not performed and the operation disable command is not output to the driver 14, whereby the driver 14 starts operation and torque is generated. This is point f in FIGS. 15(*a*) and (*c*). Hereafter, as described previously, the processing that the position deviation value is cleared when it exceeds the first set value P will be performed shortly (point g in FIG. 15(*c*)).

Figure 16:
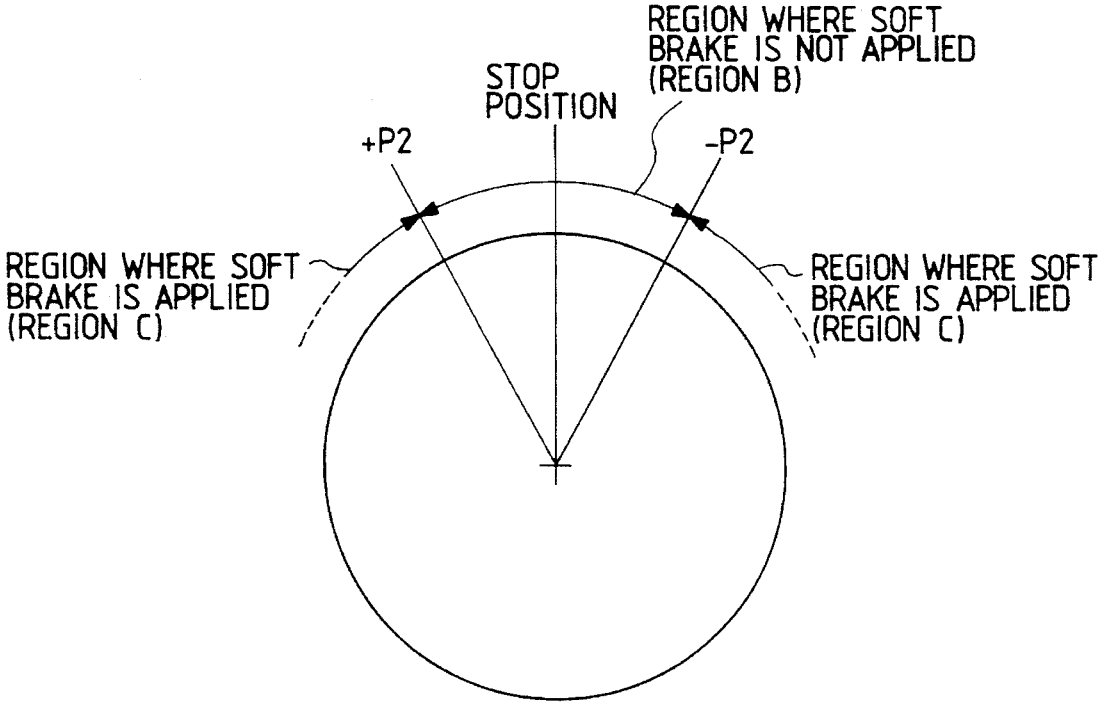
FIG. 16 illustrates an operation region as viewed from a motor pulley according to the fourth embodiment of the fourth invention.

Accordingly, since the position deviation remains zero if the sewing machine 1 does not move, the driver 14 does not operate and the motor 2 is not energized. Namely, since the operation performed is the same as when the soft brake is not operated, excitation noise is not generated, either. This operation as viewed on the motor pulley side is shown in FIG. 16.

As described above, the present embodiment is designed to disable the soft brake from being operated if the position deviation from the stop position is within 2 degrees on the shaft of the motor 2, whereby the soft brake is not operated if the sewing machine 1 does not move. Accordingly, the noise generated when the sewing machine 1 is not moving is eliminated and the sewing machine drive apparatus is quieter than the conventional machine.

It will be recognized that the present embodiment will not operate the soft brake if the position deviation from the stop position is within 2 degrees on the shaft of the motor 2, but that other embodiments may be designed not to be operated if the position deviation from the stop position is within an optional angle.

Also, when the sewing machine 1 used can be positioned to a stop at its needle UP or DOWN position under the control of the signal from the needle position detector 6 as described previously, the soft brake may be operated not according to the angle of the motor 2 or the sewing machine 1 but in relation to the signal from said needle position detector 6, e.g., when the UP position signal or the DOWN position signal is switched off (switched off when the sewing machine is offset from the stop position), in order to provide the same effects.

It will be apparent that the present invention achieves a sewing machine drive apparatus wherein the intensity of holding force generated to keep a sewing machine from being moved during a sewing machine stop can be changed according to the speed of drive means, e.g., a motor, or the sewing machine, whereby when attempting to move the sewing machine by hand, the worker can move the sewing machine easily with small power as compared to the conventional apparatus.

It will also be apparent that the present invention achieves a sewing machine drive apparatus wherein the intensity of holding force generated to keep a sewing machine from being moved during a sewing machine stop can be changed according to the pulley ratio of the pulley diameter of the drive apparatus and that of the sewing machine, whereby the power required when the worker attempts to move the sewing machine by hand is independent of the pulley ratio and the worker can move the sewing machine with constant power at any pulley ratio.

It will be also apparent that the present invention achieves a sewing machine drive apparatus wherein the intensity of holding force generated to keep a sewing machine from being moved during a sewing machine stop is reduced as the position deviation from a stop position is increased, whereby when attempting to move the sewing machine by hand, the worker can move the sewing machine easily with small power as compared to the conventional apparatus.

It will further be apparent that the present invention achieves a sewing machine drive apparatus wherein the control of holding force generated to keep a sewing machine from being moved during a sewing machine stop is started when the motion of drive means, e.g., a motor, or the sewing machine is detected, whereby noise generated when the sewing machine is not moving has been eliminated and a silent sewing machine drive apparatus can be provided.

The entire disclosure of each and every foreign patent application from which the benefit of foreign priority has been claimed in the present application is incorporated herein by reference, as if fully set forth.

Although this invention has been described in at least one preferred embodiment with a certain degree of particularity, it is to be understood that the present disclosure of the preferred embodiment has been made only by way of example and that numerous changes in the details and arrangement of components may be made without departing from the spirit and scope of the invention as hereinafter claimed.

What is claimed is:

1. A sewing machine drive apparatus for controllably driving a sewing machine comprising:

an output shaft;

drive means operable to move said output shaft at a controlled speed and to drive said sewing machine;

detection means for detecting a movement corresponding to movement of said output shaft;

control means for controlling the speed of said drive means, including a stop, according to velocity commands;

holding force generation means for generating a holding force during a stop of said sewing machine; and holding force changing means responsive to said detection means for changing the holding force generated by said holding force generation means according to the movement of said drive means.

2. The sewing machine drive apparatus as set forth in claim 1, wherein said detection means is operative to detect at least one of rotary position and velocity of said drive means.

3. The sewing machine drive apparatus as set forth in claim 1, wherein said detection means is operative to detect at least one of rotary position and velocity of said sewing machine.

4. A sewing machine drive apparatus as set forth in claim 1, wherein said holding force changing means is operative to change the holding force generated by said holding force generation means according to the pulley ratio defined by the pulley diameter of said drive means and the pulley diameter of said sewing machine.

5. A sewing machine drive apparatus as set forth in claim 1, wherein said holding force changing means is responsive to said detection means and is operative to reduce said holding force when position deviation from a stop position exceeds a predetermined value.

6. A sewing machine drive apparatus as set forth in claim 1, wherein said holding force changing means is operative to apply said holding force in response to the detection of movement by said detection means.

7. A sewing machine drive apparatus as set forth in claim 1, wherein said holding force changing means comprises calculating means responsive to said detection means output for calculating position deviation values and integrating means for receiving said position deviation values and for generating a velocity command value, said integrating means being operative to reduce said velocity command value when said position deviation value exceeds a predetermined first value.

8. A sewing machine drive apparatus as set forth in claim 1, wherein said holding force changing means is operative to change the intensity of torque applied to said output shaft in response to rotation velocity.

9. The sewing machine drive apparatus as set forth in claim 1, wherein said detection means comprises a needle position up/down detector.

10. A method of controlling a sewing machine having a drive apparatus comprising a velocity controllable drive with an output shaft that is moveable to detectable rotary positions and at detectable velocity comprising:

selectively providing a speed control for said drive apparatus according to a velocity command;

selectively providing a holding force at a first level when said drive apparatus is stopped at a stop position;

detecting movement corresponding to movement of said drive apparatus after said stop;

determining whether said movement exceeds a predetermined value; and if said predetermined value is exceeded, changing said holding force.

11. The method of controlling a sewing machine as set forth in claim 10, wherein said changing step comprises changing said holding force to a second level lower than said first level.

12. The method of controlling a sewing machine as set forth in claim 10, wherein said holding force providing step comprises providing a first force level for a range of first position deviation values and providing a second force level when said first position deviation value range is exceeded.

13. The method of controlling a sewing machine as set forth in claim 12, wherein said first force level substantially equals zero.

14. The method of controlling a sewing machine as set forth in claim 10, wherein said motion detecting step comprises detecting at least one of position deviation from said stop position and velocity.

15. The method of controlling a sewing machine as set forth in claim 10, wherein said motion detecting step comprises detecting position deviation, said determining step comprises integrating said detected position deviation to produce a velocity command value and said changing step comprises reducing said velocity command value.

16. The method of controlling a sewing machine as set forth in claim 10, wherein said selective providing step comprises disabling said drive apparatus until the position deviation from a stop position exceeds a predetermined value, and generating a holding force only after said predetermined value has been exceeded.

17. The method of controlling a sewing machine as set forth in claim 10, wherein said selective providing step comprises providing a reduced holding force having an inverse relation to the amount of position deviation from a stop.

18. The method of controlling a sewing machine as set forth in claim 10, wherein said selective providing step comprises detecting movement corresponding to the velocity of said drive apparatus and, in response thereto, correspondingly reducing said holding force.

19. The method of controlling a sewing machine as set forth in claim 10, wherein said selective providing step comprises providing said holding force in accordance with a pulley ratio.

20. The method of controlling a sewing machine as set forth in claim 10, wherein said detecting step comprises detecting needle up or down motion.

21. A sewing machine drive apparatus as set forth in claim 1, wherein said holding force generation means generates a holding force only when said detection means detects that said output shaft has moved a predetermined amount.

* * * * *